US010571156B2

(12) United States Patent
Birkelund

(10) Patent No.: US 10,571,156 B2
(45) Date of Patent: Feb. 25, 2020

(54) SELF-REGULATING VALVE FOR A VAPOUR COMPRESSION SYSTEM

(71) Applicant: Danfoss A/S, Nordborg (DK)

(72) Inventor: Michael Birkelund, Middelfart (DK)

(73) Assignee: Danfoss A/S, Nordborg (DK)

( * ) Notice: Subject to any disclaimer, the term of this patent is extended or adjusted under 35 U.S.C. 154(b) by 40 days.

(21) Appl. No.: 15/575,473

(22) PCT Filed: May 13, 2016

(86) PCT No.: PCT/EP2016/060862
§ 371 (c)(1),
(2) Date: Nov. 20, 2017

(87) PCT Pub. No.: WO2016/188776
PCT Pub. Date: Dec. 1, 2016

(65) Prior Publication Data

US 2018/0156497 A1 Jun. 7, 2018

(30) Foreign Application Priority Data

May 28, 2015 (EP) ..... 15169552

(51) Int. Cl.
*F25B 1/08* (2006.01)
*F25B 41/04* (2006.01)
(Continued)

(52) U.S. Cl.
CPC ..... *F25B 1/08* (2013.01); *F25B 9/08* (2013.01); *F25B 27/02* (2013.01); *F25B 41/043* (2013.01);
(Continued)

(58) Field of Classification Search
CPC .... F25B 1/08; F25B 27/02; F25B 9/08; F25B 41/00; F25B 41/043; F25B 2400/23;
(Continued)

(56) References Cited

U.S. PATENT DOCUMENTS 2,886,245 A * 5/1959 Giesler ..... F16K 11/24 236/12.13
4,341,086 A * 7/1982 Ishii ..... F25B 1/00 236/92 B
(Continued)

FOREIGN PATENT DOCUMENTS

CN 1422367 A 6/2003
CN 101245864 A 8/2008
(Continued)

OTHER PUBLICATIONS

International Search Report for PCT Serial No. PCT/EP2016/060862 dated Aug. 3, 2016.
(Continued)

*Primary Examiner* — Elizabeth J Martin
(74) *Attorney, Agent, or Firm* — McCormick, Paulding & Huber PLLC

(57) ABSTRACT

A valve (9) for use in a vapour compression system (1) is disclosed. The valve (9) comprises a first inlet (13) arranged to be connected to a gaseous outlet (11) of a receiver (6), a second inlet (14) arranged to be connected to an outlet of an evaporator (8), a first outlet (15) arranged to be connected to an inlet of a compressor unit (2), a non-return valve arrangement (19) arranged to allow a fluid flow from the second inlet (14) towards the first outlet (15), but to prevent a fluid flow from the first outlet (15) towards the second inlet (14), and a control valve mechanism (20) arranged to control a fluid flow from the first inlet (13) towards the first outlet (15).

17 Claims, 11 Drawing Sheets

(51) Int. Cl.
*F25B 9/08* (2006.01)
*F25B 27/02* (2006.01)

(52) U.S. Cl.
CPC ... *F25B 2341/0012* (2013.01); *F25B 2400/23* (2013.01)

(58) Field of Classification Search
CPC ..... F25B 2400/16; F25B 2400/13; F25B 2341/0012; F25B 2600/2509
See application file for complete search history.

(56) References Cited

U.S. PATENT DOCUMENTS

| | | | | |
|---|---|---|---|---|
| 4,442,680 | A * | 4/1984 | Barbier | F25B 41/043 137/489.5 |
| 2004/0003608 | A1* | 1/2004 | Takeuchi | B60H 1/3204 62/170 |
| 2004/0123624 | A1 | 7/2004 | Ohta et al. | |
| 2012/0167601 | A1 | 7/2012 | Cogswell et al. | |

FOREIGN PATENT DOCUMENTS

| | | | |
|---|---|---|---|
| CN | 102518831 | A | 6/2012 |
| CN | 103282730 | A | 9/2013 |
| DE | 10357801 | A1 | 7/2004 |
| GB | 798298 | A1 | 7/1958 |
| GB | 2484157 | A | 4/2012 |

OTHER PUBLICATIONS

First Examination Report for Indian Serial No. 201717046807 dated Dec. 10, 2019.

* cited by examiner

SELF-REGULATING VALVE FOR A VAPOUR COMPRESSION SYSTEM

CROSS-REFERENCE TO RELATED APPLICATIONS

This application is a National Stage application of International Patent Application No. PCT/EP2016/060862, filed on May 13, 2016, which claims priority to European Patent Application No. 15169552.5, filed on May 28, 2015, each of which is hereby incorporated by reference in its entirety.

TECHNICAL FIELD

The present invention relates to a valve for a vapour compression system, the vapour compression system being of a kind which comprises an ejector. The valve according to the invention is capable of controlling refrigerant flows between a receiver, an evaporator, an ejector and a compressor unit of the vapour compression system without requiring separate control of the valve. The invention further relates to a vapour compression system comprising such a valve.

BACKGROUND

In some vapour compression systems an ejector is arranged in a refrigerant path, at a position downstream relative to a heat rejecting heat exchanger. Thereby refrigerant leaving the heat rejecting heat exchanger is supplied to a primary inlet of the ejector. Refrigerant leaving an evaporator of the vapour compression system may be supplied to a secondary inlet of the ejector.

An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described will cause the refrigerant to perform work, and thereby the power consumption of the vapour compression system is reduced as compared to the situation where no ejector is provided. It is desirable to allow as large a portion as possible of the refrigerant leaving the evaporator to be supplied to the secondary inlet of the ejector.

An outlet of the ejector is normally connected to a receiver, in which liquid refrigerant is separated from gaseous refrigerant. The liquid part of the refrigerant is supplied to the evaporator, via an expansion device. The gaseous part of the refrigerant may be supplied to a compressor. Thereby the gaseous part of the refrigerant is not subjected to the pressure drop introduced by the expansion device, and the work required in order to compress the refrigerant can therefore be reduced.

When the ambient temperature is high, such as during the summer period, the temperature as well as the pressure of the refrigerant leaving the heat rejecting heat exchanger is relatively high. In this case the ejector performs well, and it is advantageous to supply all of the refrigerant leaving the evaporator to the secondary inlet of the ejector, and to supply gaseous refrigerant to the compressors from the receiver only. When the vapour compression system is operated in this manner, it is sometimes referred to as 'summer mode'.

On the other hand, when the ambient temperature is low, such as during the winter period, the temperature as well as the pressure of the refrigerant leaving the heat rejecting heat exchanger is relatively low. In this case the ejector is not performing well, and it is advantageous to supply the refrigerant leaving the evaporator to the compressors, instead of to the secondary inlet of the ejector. When the vapour compression system is operated in this manner, it is sometimes referred to as 'winter mode'.

When the ambient temperature changes from a temperature regime which may be regarded as corresponding to 'summer mode' operating conditions to a temperature regime which may be regarded as corresponding to 'winter mode' operating conditions, or vice versa, it is desirable to be able to ensure that vapour compression system is also switched from operating in the 'summer mode' to operating in the 'winter mode', or vice versa.

US 2012/0167601 A1 discloses an ejector cycle. A heat rejecting heat exchanger is coupled to a compressor to receive compressed refrigerant. An ejector has a primary inlet coupled to the heat rejecting heat exchanger, a secondary inlet and an outlet. A separator has an inlet coupled to the outlet of the ejector, a gas outlet and a liquid outlet. The system can be switched between first and second modes. In the first mode refrigerant leaving the heat absorbing heat exchanger is supplied to the secondary inlet of the ejector. In the second mode refrigerant leaving the heat absorbing heat exchanger is supplied to the compressor.

SUMMARY

It is an object of embodiments of the invention to provide a valve for use in a vapour compression system comprising an ejector, the valve being capable of automatically ensuring that the ejector operates efficiently, regardless of the ambient temperature.

It is a further object of embodiments of the invention to provide a vapour compression system comprising an ejector, in which efficient operation of the ejector is ensured, regardless of the ambient temperature.

According to a first aspect the invention provides a valve for use in a vapour compression system, the valve comprising:

- a first inlet arranged to be connected to a gaseous outlet of a receiver,
- a second inlet arranged to be connected to an outlet of an evaporator,
- a first outlet arranged to be connected to an inlet of a compressor unit,
- a non-return valve arrangement arranged to allow a fluid flow from the second inlet towards the first outlet, but to prevent a fluid flow from the first outlet towards the second inlet, and
- a control valve mechanism arranged to control a fluid flow from the first inlet towards the first outlet.

According to the first aspect the invention provides a valve for use in a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump etc.

The valve comprises a first inlet, a second inlet and a first outlet. The first inlet is arranged to be connected to a gaseous outlet of a receiver, the second inlet is arranged to be connected to an outlet of an evaporator, and the first outlet is arranged to be connected to an inlet of a compressor unit. Thus, the valve is arranged to receive refrigerant from a gaseous outlet of a receiver and from an evaporator, via the first and second inlet, respectively, and to deliver refrigerant to an inlet of a compressor unit, via the first outlet. Accordingly, the valve is arranged to control a flow of refrigerant towards the compressor unit, including controlling to which extent refrigerant supplied to the compressor unit is received from the gaseous outlet of the receiver and/or from the outlet of the evaporator.

The valve further comprises a non-return valve arrangement, which is arranged to allow a fluid flow from the second inlet towards the first outlet, but to prevent a fluid flow from the first outlet towards the second inlet. Thus, refrigerant being received at the valve from the outlet of the evaporator, via the second inlet, is allowed to pass the non-return valve arrangement and leave the valve via the second outlet, thereby being supplied to the inlet of the compressor unit. However, refrigerant being received at the valve from the gaseous outlet of the receiver, via the first inlet, is not allowed to pass the non-return valve arrangement, and is thereby prevented from reaching the second inlet. Accordingly, refrigerant received from the gaseous outlet of the receiver is only allowed to leave the valve via the first outlet, towards the inlet of the compressor unit, and a reverse flow from the inlet of the compressor unit towards the outlet of the evaporator is prevented.

The valve further comprises a control valve mechanism arranged to control a fluid flow from the first inlet towards the first outlet. Thus, the control valve mechanism controls the refrigerant flow from the gaseous outlet of the receiver to the inlet of the compressor unit, via the valve. Due to the control valve mechanism, the valve is capable of controlling to which extent the refrigerant supplied to the inlet of the compressor unit originates from the gaseous outlet of the receiver and/or from the outlet of the evaporator, without the need for any further components. Accordingly, the valve may be regarded as a self-contained unit, which is capable of readily ensuring that the refrigerant supplied to the compressor unit is an appropriate mixture of refrigerant received from the gaseous outlet of the receiver and from the outlet of the evaporator, respectively. This is an advantage, because this is an easy and reliable manner of ensuring that the vapour compression system is operated in an efficient manner, regardless of the ambient temperature.

The control valve mechanism may be automatically operated in response to a pressure difference between a pressure prevailing at the first inlet and a pressure prevailing at the second inlet. According to this embodiment, an appropriate mixture of refrigerant received from the gaseous outlet of the receiver and from the outlet of the evaporator, respectively, is automatically obtained in accordance with the pressures prevailing at the first and second inlets, and thereby in accordance with the prevailing operating conditions. Thereby it is automatically obtained that the refrigerant supply to the inlet of the compressor unit is in accordance with the prevailing operating conditions, including the pressures prevailing in various parts of the vapour compression system and a prevailing ambient temperature, and efficient operation of the vapour compression system is therefore automatically obtained regardless of the prevailing operating conditions, including a prevailing ambient temperature, without the need for active control of the valve.

The control valve mechanism may be operated in a purely mechanical manner and/or in a passive manner, i.e. without the need for software actively controlling the control valve mechanism. For instance, changes in a pressure difference across the control valve mechanism may cause one or more mechanical parts of the control valve mechanism to move, thereby operating the control valve mechanism. As an alternative, the control valve mechanism may be at least partly actively controlled, e.g. using software for controlling the control valve mechanism.

For instance, when the ambient temperature is relatively high, such as during summer time, the pressure in the receiver must be expected to be relatively high. Thereby the pressure prevailing at the first inlet of the valve, which is connected to the gaseous outlet of the receiver, is also high. This will most likely result in a relatively high pressure difference between the pressure prevailing at the first inlet and the pressure prevailing at the second inlet. This high pressure difference will cause the control valve mechanism to be automatically operated in such a manner that the amount of refrigerant supplied from the gaseous outlet of the receiver to the inlet of the compressor unit, via the valve, is increased. Thus, it is automatically obtained that the vapour compression system is operated according to a 'summer mode' in this case.

On the other hand, when the ambient temperature us relatively low, such as during winter time, the pressure in the receiver, and thereby the pressure prevailing at the first inlet of the valve, must be expected to be relatively low. This will most likely result in a relatively low pressure difference between the pressure prevailing at the first inlet and the pressure prevailing at the second inlet. This low pressure difference will cause the control valve mechanism to be automatically operated in such a manner that the amount of refrigerant supplied from the gaseous outlet of the receiver to the inlet of the compressor unit, via the valve, is decreased, possibly to the extent that no refrigerant is being supplied from the gaseous outlet of the receiver to the inlet of the compressor unit. Instead the refrigerant being supplied to the compressor unit will solely or primarily originate from the outlet of the evaporator. Thus, it is automatically obtained that the vapour compression system is operated according to a 'winter mode' in this case.

In summary, according to this embodiment, the vapour compression system is automatically switched between operating according to a 'summer mode' and according to a 'winter mode' when appropriate. Furthermore, this switch may occur gradually and smoothly.

The control valve mechanism may comprise a movable valve element being arranged movably with respect to an opening interconnecting the first inlet and the first outlet, the position of the movable valve element relative to the opening determining an opening degree of the opening, and thereby a fluid flow from the first inlet towards the first outlet. According to this embodiment, the fluid flow from the first inlet towards the first outlet is controlled by moving the movable valve element with respect to the opening, thereby adjusting the opening degree of the opening. This is an easy manner of controlling the control valve.

The movements of the movable valve element may be performed in an active manner. As an alternative, the movements of the movable valve element may be performed in a passive manner, e.g. in response to a pressure difference between a pressure prevailing at the first inlet and a pressure prevailing at the second inlet, as described above.

The movable valve element may be biased towards a position which defines a zero opening degree of the opening. According to this embodiment, the opening is normally closed, and work is required in order to open the opening, i.e. in order to move the movable valve element in a manner which increases the opening degree of the opening. The bias may, e.g., be provided by means of a spring, such as a compressible spring, which pushes the movable valve element towards the closed position. The movable valve element may, e.g., be pushed against the biasing force, by means of a pressure difference across the movable valve element.

As an alternative, the movable valve element may be un-biased, or it may be biased towards a position which defines a maximum opening degree of the opening.

The movable valve element may be arranged to perform sliding movements relative to the opening. According to this embodiment, the movable valve element slides in front of the opening in such a manner that an area of the opening being covered by the movable valve element is variable. An uncovered portion of the opening defines the opening degree of the opening. The movable valve element may, in this case, advantageously have a disk-like shape.

As an alternative, the movable valve element may be movable towards and away from the opening, in which case the opening may form a traditional valve seat for the valve element. In this case the valve element may have a circular or conical shape which is arranged to enter the opening, thereby cooperating with the opening in defining the opening degree.

The non-return valve arrangement may be arranged to close, thereby preventing a fluid flow from the first outlet towards the second inlet, in the case that a pressure prevailing at the first outlet exceeds a pressure prevailing at the second inlet. According to this embodiment, the non-return valve arrangement is automatically operated on the basis of the pressures prevailing at the first outlet and the second inlet, respectively. Thus, in the case that the pressure prevailing at the first outlet exceeds the pressure prevailing at the second inlet, the non-return valve arrangement will automatically close, and a reverse flow from the first outlet towards the second inlet, and thereby towards the outlet of the evaporator, is automatically prevented.

The non-return valve arrangement may further be arranged to prevent a fluid flow from the second inlet towards the first outlet, in the case that a pressure prevailing at the first outlet exceeds a pressure prevailing at the second inlet. According to this embodiment, in the case that the pressure prevailing at the first outlet exceeds the pressure prevailing at the second inlet, refrigerant will be prevented from passing the non-return valve in a direction from the second inlet towards the first outlet. This may, e.g., be obtained purely due to the higher pressure prevailing at the first outlet, i.e. the refrigerant would have to flow towards a region with a higher pressure in order to pass the non-return valve. Thereby refrigerant will not be allowed to pass from the outlet of the evaporator to the inlet of the compressor unit, via the valve, in this case. Accordingly, the refrigerant leaving the evaporator will not be supplied to the inlet of the compressor unit, and the compressor unit will only receive refrigerant from the gaseous outlet of the receiver. The refrigerant leaving the evaporator may, e.g., be supplied to a secondary inlet of an ejector, and the vapour compression system may thereby be operated according to a 'summer mode' in this case.

The valve may further comprise a second outlet arranged to be connected to a secondary inlet of an ejector. According to this embodiment, the valve is further arranged to control a flow of refrigerant towards the secondary inlet of the ejector. Thereby the valve further controls how large a portion of the refrigerant leaving the evaporator is supplied to the inlet of the compressor unit, and how large a portion is supplied to the secondary inlet of the ejector. Thus, the valve may be regarded as a self-contained unit which receives refrigerant from the gaseous outlet of the receiver and the outlet of the evaporator, and supplies refrigerant to the inlet of the compressor unit and the secondary inlet of the ejector. How the refrigerant flows through the valve from the first and second inlets to the first and second outlets is determined by the control valve mechanism and the non-return valve arrangement, essentially in the manner described above. Furthermore, appropriate control of the refrigerant flow through the valve is obtained without the need for any further components, possibly without the need for actively controlling the valve, while taking the prevailing operating conditions, such as prevailing ambient temperature, into account.

The valve may further comprise a separator arranged to separate refrigerant entering the valve via the second inlet into a liquid part and a gaseous part, said separator being arranged between the second inlet, the non-return valve arrangement and the second outlet. According to this embodiment, refrigerant leaving the evaporator and entering the second inlet of the valve may be partly in gaseous form and partly in liquid form. In the separator the refrigerant is separated into a liquid part and a gaseous part. The liquid part of the refrigerant is supplied to the secondary inlet of the ejector, via the second outlet of the valve, and the gaseous part of the refrigerant is at least partly supplied to the inlet of the compressor unit, via the non-return valve arrangement and the first outlet of the valve. Thereby the evaporator may be flooded, i.e. liquid refrigerant may be allowed to pass through the evaporator, without risking that liquid refrigerant reaches the compressors of the compressor unit. This is an advantage, because thereby the potential cooling capacity of the evaporator can be utilised to the greatest possible extent, thereby maximizing the efficiency of the vapour compression system, without risking damage to the compressors.

The separator may, e.g., be in the form of a cyclone.

According to an alternative embodiment, the valve may not comprise a second outlet. In this case the vapour compression system may be of a kind which is not provided with an ejector. In this case the valve may, e.g., be used in a vapour compression system comprising an expander. Alternatively, the outlet of the evaporator may be connected to the second inlet of the valve as well as directly to the secondary inlet of an ejector. In this case the valve is not directly used for controlling the refrigerant flow from the outlet of the evaporator towards the secondary inlet of the ejector. A separator may, in this case, be arranged in the refrigerant path between the outlet of the evaporator and the second inlet of the valve, in order to ensure that liquid refrigerant is not allowed to enter the valve via the second inlet, but is instead supplied to the secondary inlet of the ejector.

According to a second aspect the invention provides a vapour compression system comprising a compressor unit comprising one or more compressors, a heat rejecting heat exchanger, an ejector, a receiver an expansion device and an evaporator arranged in a refrigerant path, an outlet of the heat rejecting heat exchanger being connected to a primary inlet of the ejector and an outlet of the ejector being connected to the receiver, wherein the vapour compression system further comprises a valve according to the first aspect of the invention, the first inlet of the valve being connected to a gaseous outlet of the receiver, the second inlet of the valve being connected to an outlet of the evaporator and the first outlet of the valve being connected to an inlet of the compressor unit.

It should be noted that a person skilled in the art would readily recognise that any features described in combination with the first aspect of the invention could also be described in combination with the second aspect of the invention, and vice versa.

The vapour compression system according to the second aspect of the invention comprises a compressor unit comprising one or more compressors, a heat rejecting heat exchanger, an ejector, a receiver, an expansion device, an evaporator and a valve according to the first aspect of the invention arranged in a refrigerant path.

Refrigerant is compressed by the compressors of the compressor unit, and the compressed refrigerant is supplied to the heat rejecting heat exchanger. In the heat rejecting heat exchanger heat exchange takes place between the refrigerant and the ambient, in such a manner that heat is rejected from the refrigerant to the ambient. The heat rejecting heat exchanger may be in the form of a condenser, in which case the refrigerant passing through the heat rejecting heat exchanger is at least partly condensed. As an alternative, the heat rejecting heat exchanger may be in the form of a gas cooler, in which case the refrigerant passing through the heat rejecting heat exchanger remains in the gaseous phase.

The refrigerant leaving the heat rejecting heat exchanger is supplied to a primary inlet of the ejector, and refrigerant leaving the ejector is supplied to the receiver. In the receiver the refrigerant is separated into a liquid part and a gaseous part. The liquid part of the refrigerant is supplied to the expansion device, which may be in the form of an expansion valve, via a liquid outlet of the receiver. When passing through the expansion device the refrigerant is expanded before being supplied to the evaporator. Thereby the refrigerant supplied to the evaporator is a mixture of liquid and gaseous refrigerant.

In the evaporator heat exchange takes place between the refrigerant and the ambient in such a manner that heat is absorbed by the refrigerant from the ambient, while the refrigerant is at least partly evaporated.

The refrigerant leaving the evaporator is supplied to a secondary inlet of the ejector and/or to the second inlet of the valve. Thus, all of the refrigerant leaving the evaporator may be supplied to the secondary inlet of the ejector, or all of the refrigerant leaving the evaporator may be supplied to the second inlet of the valve, or some of the refrigerant leaving the evaporator may be supplied to the secondary inlet of the ejector and some of the refrigerant leaving the evaporator may be supplied to the second inlet of the valve.

Refrigerant being supplied to the valve passes the valve, essentially as described above, and is supplied to the compressors of the compressor unit via the first outlet of the valve. The pressure energy of the refrigerant being supplied to the secondary inlet of the ejector is increased, as described above, before being supplied to the receiver.

The gaseous part of the refrigerant in the receiver is supplied directly to the first inlet of the valve, and is supplied to the compressors of the compressor unit, via the first outlet of the valve.

Thus, the refrigerant flowing in the refrigerant path is alternatingly compressed by means of the compressors and expanded by means of the expansion device, while heat exchange takes place at the heat rejecting heat exchanger and the evaporator. Thereby heating or cooling can be provided.

As described above, the valve controls the refrigerant flows from the gaseous outlet of the receiver and from the outlet of the evaporator, respectively, and towards the secondary inlet of the ejector and towards the inlet of the compressor unit, respectively.

The valve may further comprise a second outlet, and the second outlet of the valve may be connected to a secondary inlet of the ejector. According to this embodiment, the fluid flow from the outlet of the evaporator towards the secondary inlet of the ejector is controlled directly by the valve. This has already been described in detail above with reference to the first aspect of the invention.

BRIEF DESCRIPTION OF THE DRAWINGS

The invention will now be described in further detail with reference to the accompanying drawings in which.

DETAILED DESCRIPTION

Figure 1:
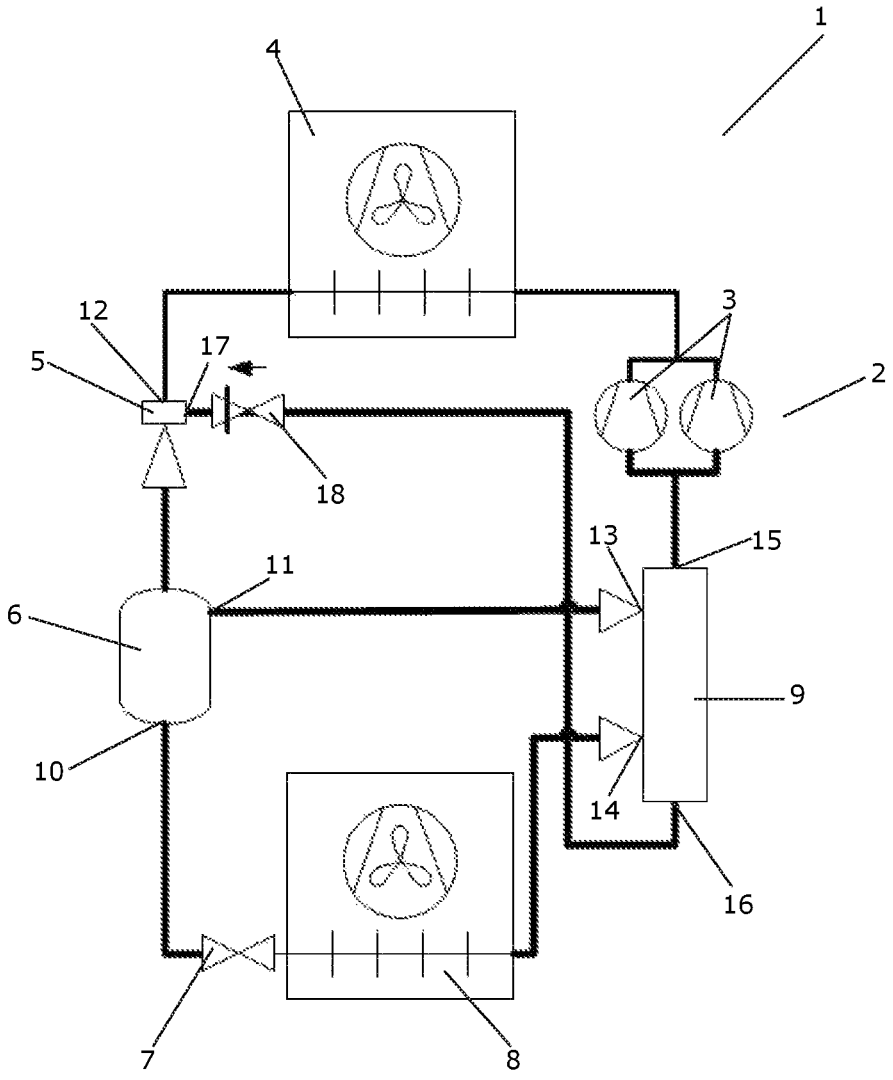
FIG. 1 is a diagrammatic view of a vapour compression system according to an embodiment of the invention.

FIG. 1 is a diagrammatic view of a vapour compression system 1 according to an embodiment of the invention. The vapour compression system 1 comprises a compressor unit 2 comprising a number of compressors 3, two of which are shown, a heat rejecting heat exchanger 4, an ejector 5, a receiver 6, an expansion device 7, in the form of an expansion valve, and an evaporator 8 arranged in a refrigerant path. The vapour compression system 1 further comprises a valve 9 according to an embodiment of the invention arranged in the refrigerant path.

The receiver 6 is arranged to separate refrigerant into a liquid part and a gaseous part, and the receiver 6 comprises a liquid outlet 10 and a gaseous outlet 11. The liquid outlet 10 is connected to the expansion device 7, i.e. the liquid part of the refrigerant in the receiver 6 is supplied to the evaporator 8, via the expansion device 7.

The vapour compression system 1 of FIG. 1 may be operated in the following manner. Refrigerant flowing in the refrigerant path is compressed by means of the compressors 3 of the compressor unit 2, and the compressed refrigerant is supplied to the heat rejecting heat exchanger 4. In the heat rejecting heat exchanger 4 heat exchange takes place between the refrigerant flowing through the heat rejecting heat exchanger 4 and the ambient, in such a manner that heat is rejected from the refrigerant to the ambient. In the case that the heat rejecting heat exchanger 4 is in the form of a condenser, the refrigerant is at least partly condensed, and in the case that the heat rejecting heat exchanger 4 is in the form of a gas cooler, the refrigerant is cooled, but remains in the gaseous phase.

The refrigerant leaving the heat rejecting heat exchanger 4 is supplied to a primary inlet 12 of the ejector 5, where the refrigerant undergoes expansion before being supplied to the receiver 6.

In the receiver 6 the refrigerant is separated into a liquid part and a gaseous part. The liquid part of the refrigerant is supplied to the expansion device 7, via the liquid outlet 10. The expansion device 7 expands the refrigerant before it is supplied to the evaporator 8. The refrigerant being supplied to the evaporator 8 is in a mixed liquid and gaseous state.

The gaseous part of the refrigerant in the receiver 6 is supplied to a first inlet 13 of the valve 9, via the gaseous outlet 11 of the receiver 6.

In the evaporator 8 the liquid part of the refrigerant is at least partly evaporated, while heat exchange takes place between the refrigerant and the ambient in such a manner that heat is absorbed by the refrigerant flowing through the evaporator 8. The refrigerant leaving the evaporator 8 is supplied to a second inlet 14 of the valve 9. Thus, the valve 9 receives refrigerant from the gaseous outlet 11 of the receiver 6, via the first inlet 13, and refrigerant from the evaporator 8, via the second inlet 14.

The valve 9 comprises a first outlet 15 connected to an inlet of the compressor unit 2 and a second outlet 16 connected to a secondary inlet 17 of the ejector 5, via a non-return valve 18. Thus, the valve 9 supplies refrigerant to the compressors 3 of the compressor unit 2, via the first outlet 15, and refrigerant to the secondary inlet 17 of the ejector 5, via the second outlet 16.

The valve 9 further comprises a non-return valve arrangement (not shown) and a control valve mechanism (not shown), as described above. Thereby the valve 9 controls refrigerant flow from the evaporator 8 and the gaseous outlet 11 of the receiver 6, respectively, and towards the compressor unit 2 and the secondary inlet 17 of the ejector 5, respectively, in a manner which will be described in further detail below with reference to FIGS. 2-6.

FIGS. 2-6 are cross sectional views of a valve 9 according to a first embodiment, in various positions.

The valve 9 of FIGS. 2-6 comprises a first inlet 13, a second inlet 14, a first outlet 15 and a second outlet 16. The first inlet 13 is connectable to a gaseous outlet of a receiver, the second inlet 14 is connectable to an outlet of an evaporator, the first outlet 15 is connectable to an inlet of a compressor unit, and the second outlet 16 is connectable to a secondary inlet of an ejector. Thus, the valve 9 receives refrigerant from the gaseous outlet of the receiver and from the evaporator, via the first 13 and the second 14 inlets, respectively, and supplies refrigerant to the compressor unit and to the secondary inlet of the ejector, via the first 15 and the second 16 outlets, respectively.

The valve 9 further comprises a non-return valve arrangement 19 and a control valve mechanism 20. The non-return valve arrangement 19 is arranged to allow a fluid flow from the second inlet 14 towards the first outlet 15, but to prevent a fluid flow from the first outlet 15 towards the second inlet 14. Thus, the non-return valve arrangement 19 allows refrigerant received from the evaporator, via the second inlet 14, to be supplied to the inlet of the compressor unit, via the first outlet 15, but prevents refrigerant received from the gaseous outlet of the receiver, via the first inlet 13, from flowing towards the second inlet 14, and thereby a reverse flow from the first outlet 15 towards the evaporator is prevented.

The control valve mechanism 20 is arranged to control the fluid flow from the first inlet 13 towards the first outlet 15. The control valve mechanism 20 comprises a movable valve element 21 arranged to perform sliding movements relative to an opening 22 interconnecting the first inlet 13 and the first outlet 15. The position of the movable valve element 21 relative to the opening 22 thereby defines a cross sectional area of a passage through which refrigerant can flow from the first inlet 13 towards the first outlet 15.

A spring 23 is arranged in contact with the movable valve element 21, thereby biasing the movable valve element 21 towards a position in which the movable valve element 21 covers the entire opening 22, i.e. towards a position which defines a zero opening degree of the opening 22. The movable valve element 21 may be moved, against the biasing force provided by the spring 23, thereby opening the opening 22 and allowing a flow of refrigerant from the first inlet 13 towards the first outlet 15, when a differential pressure across the control valve mechanism 20 is sufficiently high to overcome the biasing force provided by the spring 23. This will be described further below.

Figure 2:
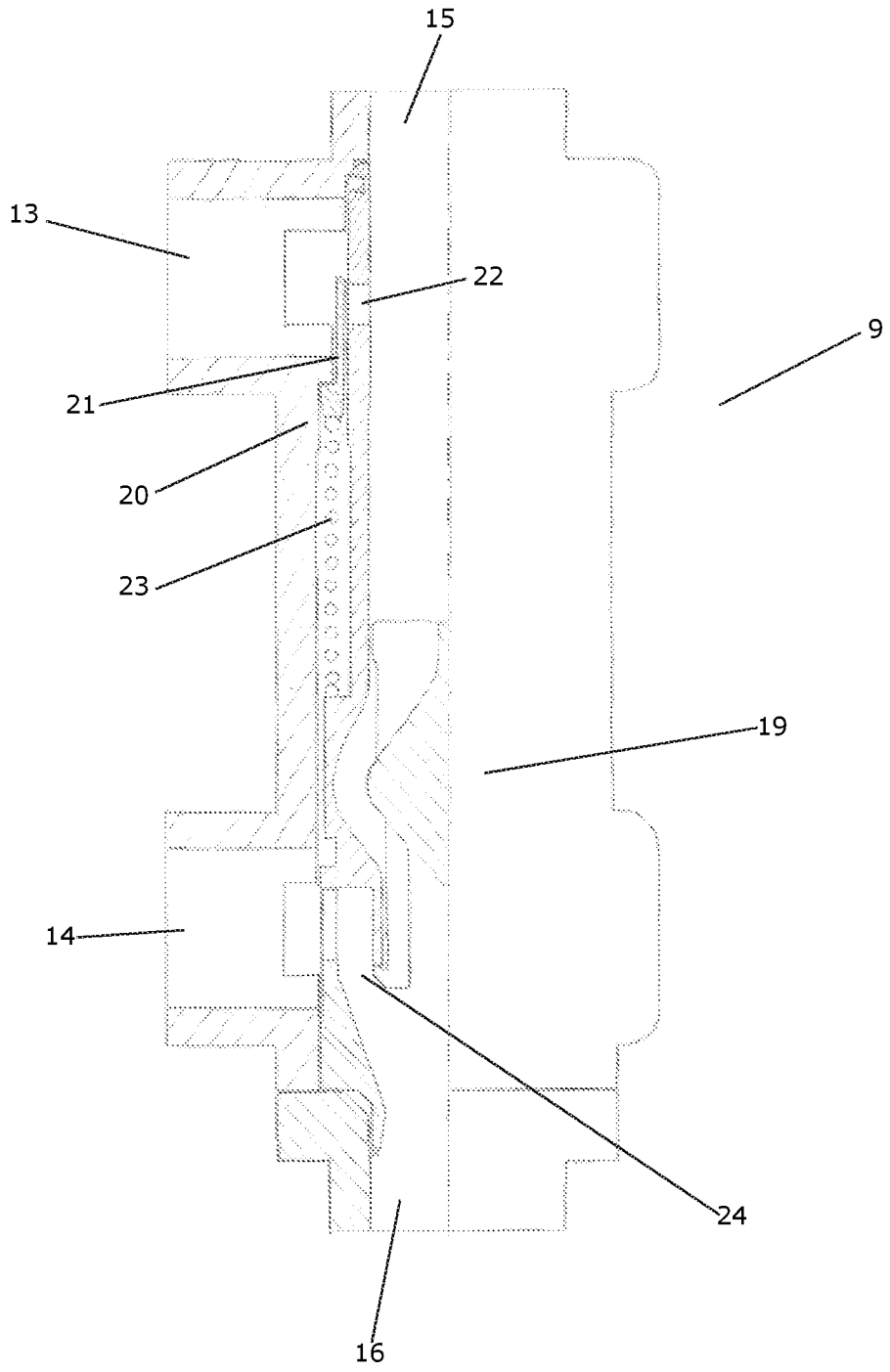
FIGS. 2-6 are cross sectional views of a valve according to a first embodiment of the invention, in various positions.

In FIG. 2 a pressure difference between a pressure prevailing at the first inlet 13 and a pressure prevailing at the second inlet 14 is relatively low. Thereby the differential pressure across the control valve mechanism 20 is not sufficiently high to overcome the biasing force provided by the spring 23. Accordingly, the spring 23 pushes the movable valve member 21 into the position where it covers the entire opening 22, i.e. the control valve mechanism 20 is in a closed position, and refrigerant is not allowed to pass from the first inlet 13 towards the first outlet 15.

The non-return valve arrangement 19 is in an open position. Thereby refrigerant entering the valve 9 from the evaporator, via the second inlet 14, is allowed to pass through the non-return valve arrangement 19, and leave the valve 9 via the first outlet 15. Furthermore, refrigerant is also allowed to flow from the second inlet 14 towards the second outlet 16, thereby being supplied to the secondary inlet of the ejector.

Figure 3:
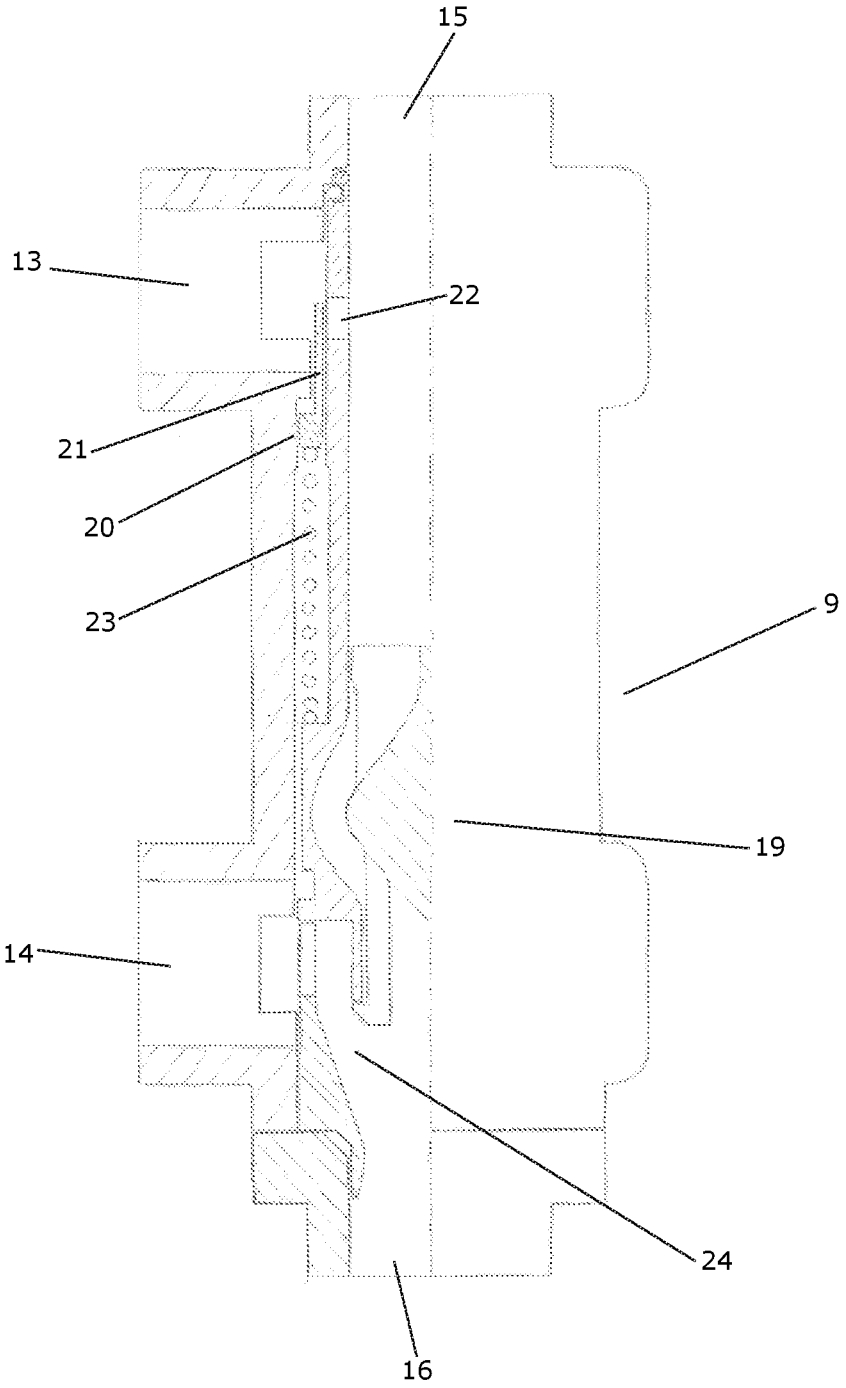

In FIG. 3 the pressure prevailing at the first inlet 13 is slightly higher than is the case in FIG. 2, and the differential pressure across the control valve mechanism 20 is therefore slightly higher. This has caused the movable valve element 21 to be moved slightly against the biasing force provided by the spring 23, and a small passage through the opening 22 has been opened. Accordingly, some refrigerant is allowed to pass from the first inlet 13 towards the first outlet 15.

The non-return valve arrangement 19 is still in an open position, allowing a flow of refrigerant from the second inlet 14 towards the first outlet 15.

Figure 4:
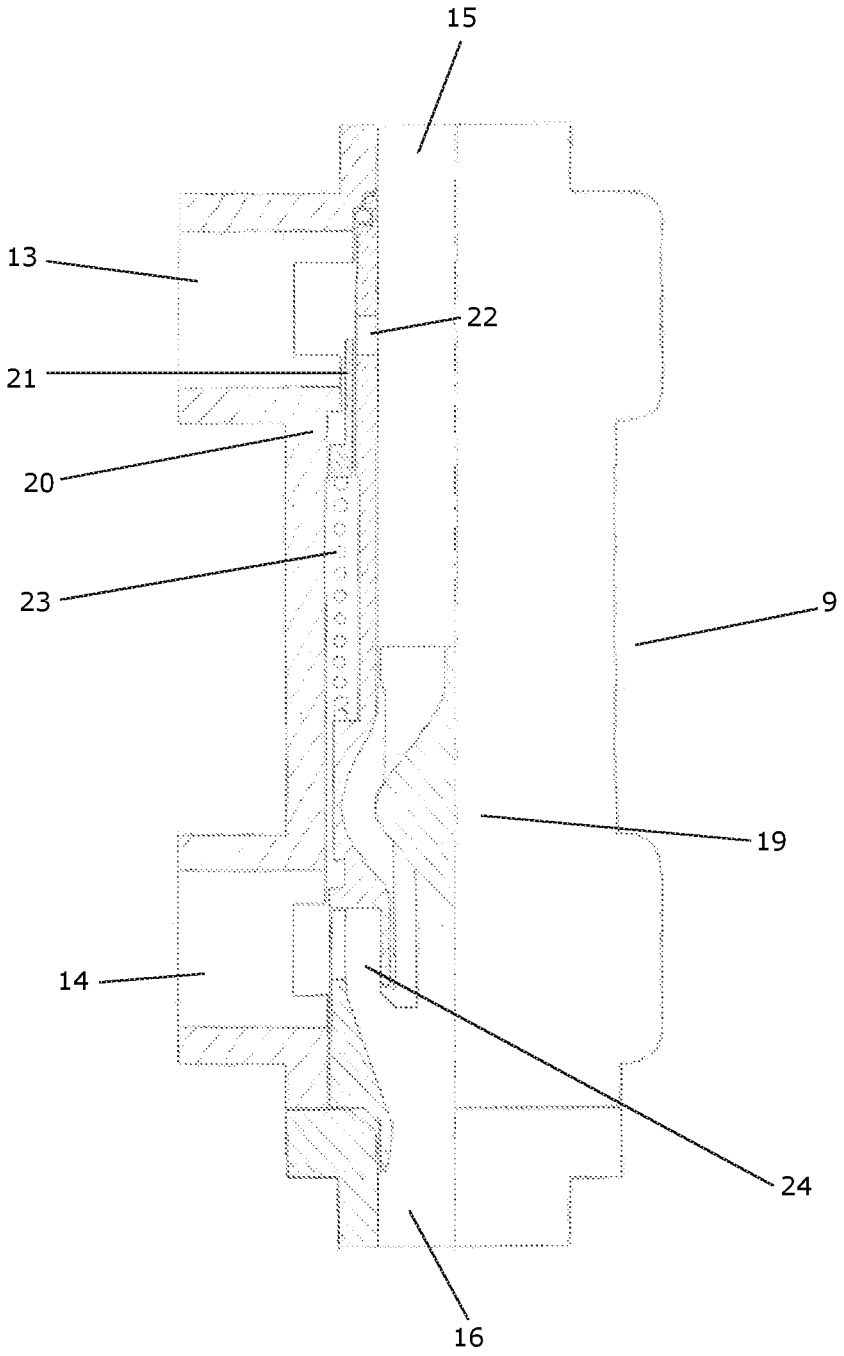

In FIG. 4 the pressure prevailing at the first inlet 13 has increased further, thereby moving the movable valve element 21 a bit further against the biasing force provided by the spring 23, thereby opening the opening 22 a bit further and allowing a bit more refrigerant to pass from the first inlet 13 towards the first outlet 15. The non-return valve arrangement 19 is still in an open position.

Figure 5:
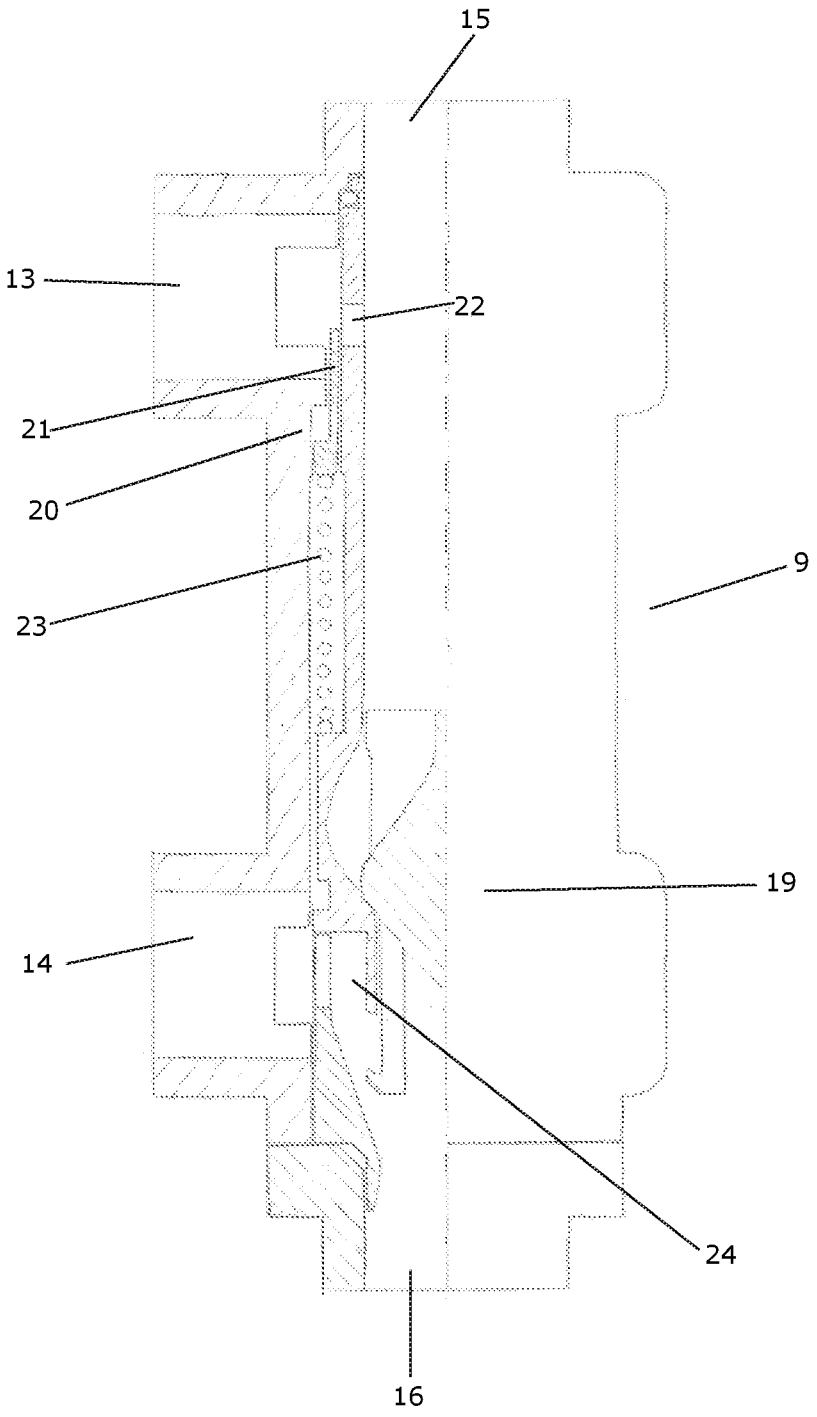

In FIG. 5 the movable valve element 21 is in the same position as in FIG. 4. The increased refrigerant flow through the opening 22, as compared to the situation illustrated in FIG. 3, has increased the pressure prevailing in a region between the opening 22 and the first outlet 15. This increase in pressure has caused the non-return valve arrangement 19 to be moved to a closed position. Thereby a flow of refrigerant from the first outlet 15 towards the second inlet 14 is prevented, i.e. refrigerant received from the gaseous outlet of the receiver, via the first inlet 13, is not allowed to flow towards the evaporator, via the second inlet 14.

Furthermore, when the non-return valve arrangement 19 is in the closed position, as shown in FIG. 5, a fluid flow from the second inlet 14 towards the first outlet 15 is also prevented. Accordingly, all of the refrigerant which is received from the outlet of the evaporator, via the second inlet 14, must leave the valve 9 via the second outlet 16, and is thereby supplied to the secondary inlet of the ejector.

Figure 6:
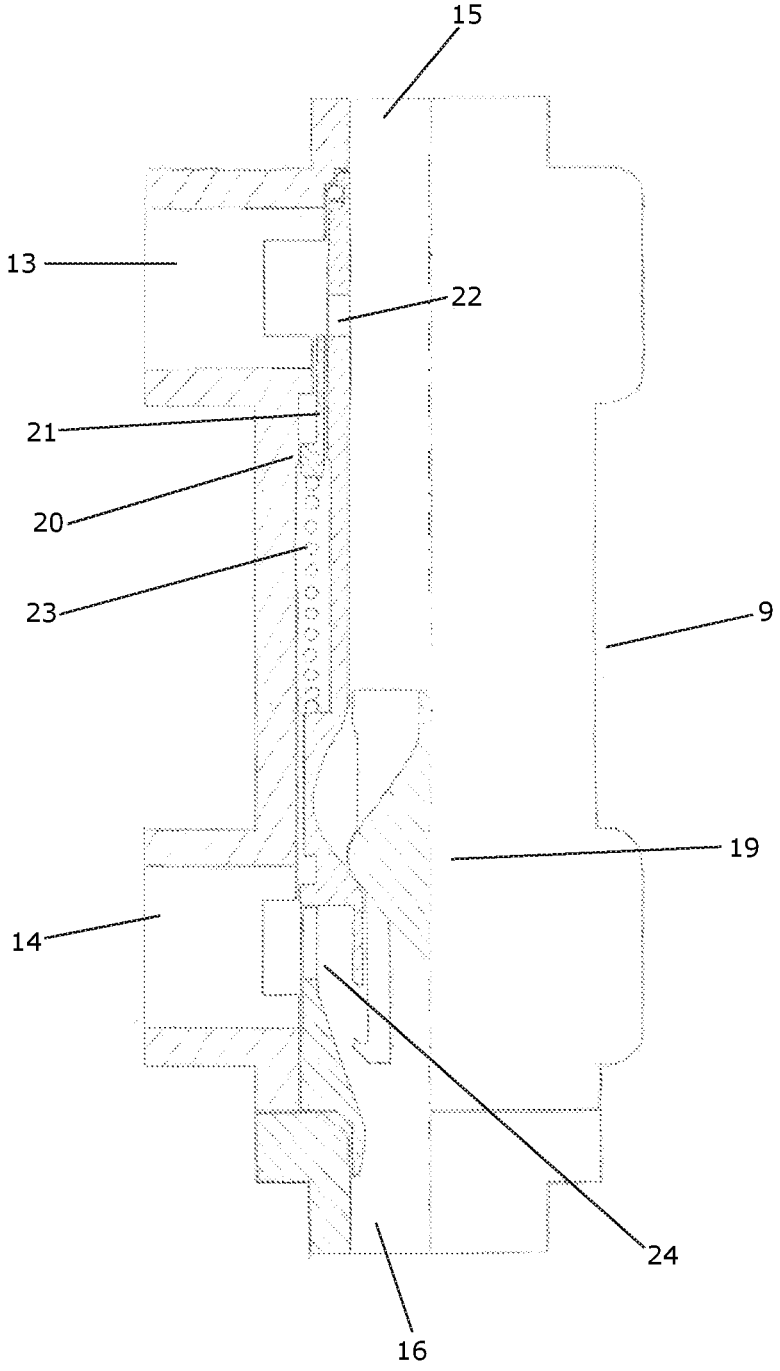

In FIG. 6 the pressure prevailing at the first inlet 13 has increased even further, thereby moving the movable valve element 21 into a position where there is no overlap between the movable valve element 21 and the opening 22. Accordingly, the control valve mechanism 20 is in a fully open position. The non-return valve arrangement 19 is still in a closed position.

In the valve 9 illustrated in FIGS. 2-6 the design of the valve 9 at the second inlet 14 is such that it operates as a separator 24. Accordingly, refrigerant entering the valve 9 via the second inlet 14 is separated into a gaseous part and a liquid part. The liquid part of the refrigerant flows towards the second outlet 16, due to gravity, and is thereby automatically supplied to the secondary inlet of the ejector. However, at least a part of the gaseous part of the refrigerant may pass through the non-return valve arrangement 19, towards the first outlet 15, thereby being supplied to the inlet of the compressor unit, to the extent that the non-return valve arrangement 19 is in an open position. Thereby it is ensured that no liquid refrigerant is supplied to the inlet of the compressor unit, even if liquid refrigerant is allowed to pass through the evaporator.

FIGS. 7-11 are cross sectional views of a valve 9 according to a second embodiment, in various positions. The valve 9 of FIGS. 7-11 is very similar to the valve 9 of FIGS. 2-6, and it will therefore not be described in detail here.

The valve 9 of FIGS. 7-11 is not provided with a second outlet. Thus, all of the refrigerant which enters the valve 9, via the first inlet 13 and via the second inlet 14, must leave the valve 9 via the first outlet 15, and is thereby supplied to the inlet of the compressor unit. Instead the refrigerant path may advantageously comprise a branch arranged between the outlet of the evaporator and the second inlet 15 of the valve 9, providing a fluid passage from the outlet of the evaporator to a secondary inlet of an ejector.

Figure 7:
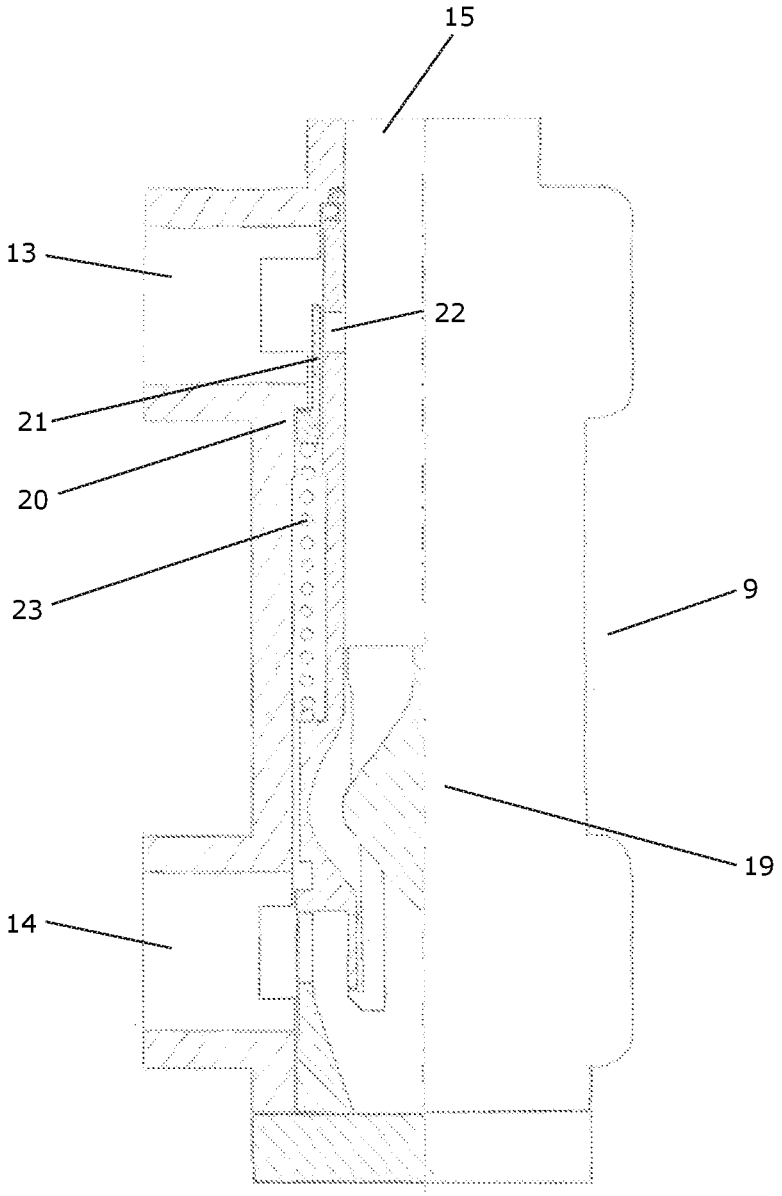
FIGS. 7-11 are cross sectional views of a valve according to a second embodiment of the invention, in various positions.
Figure 8:
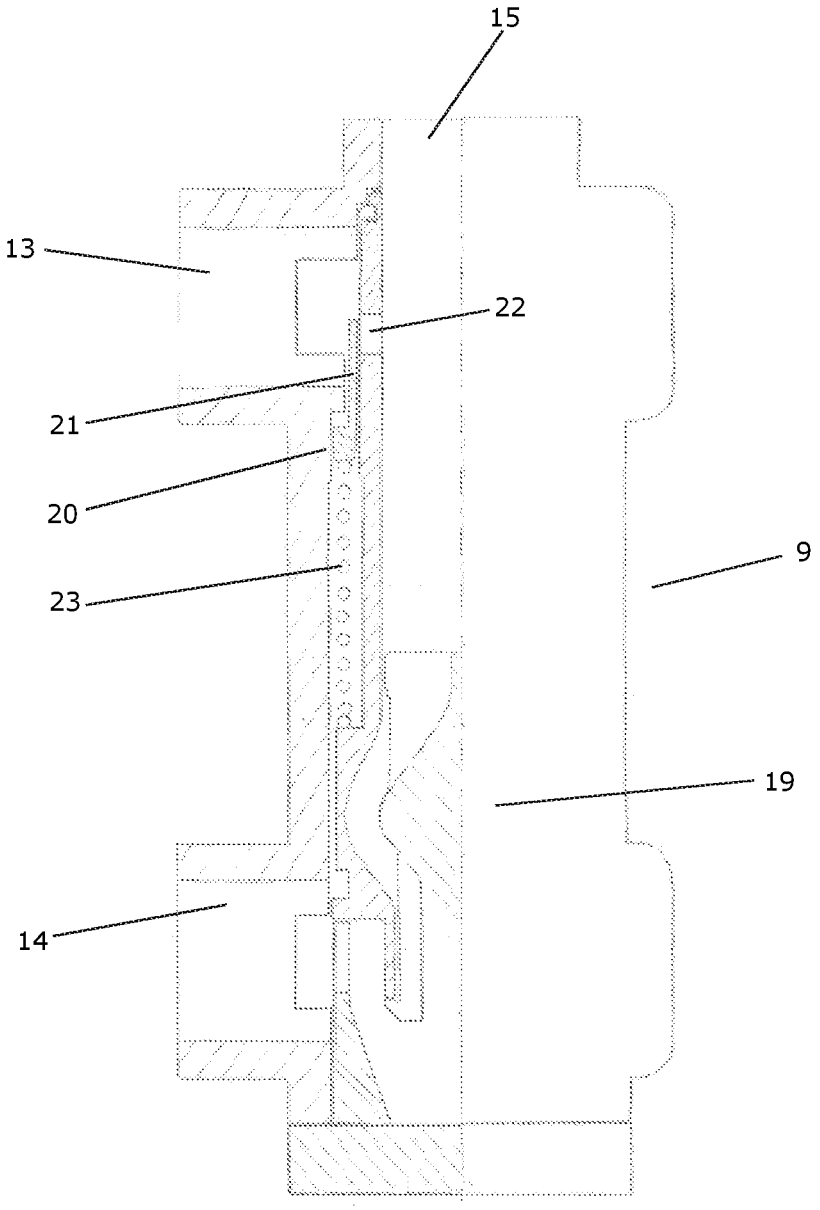
Figure 9:
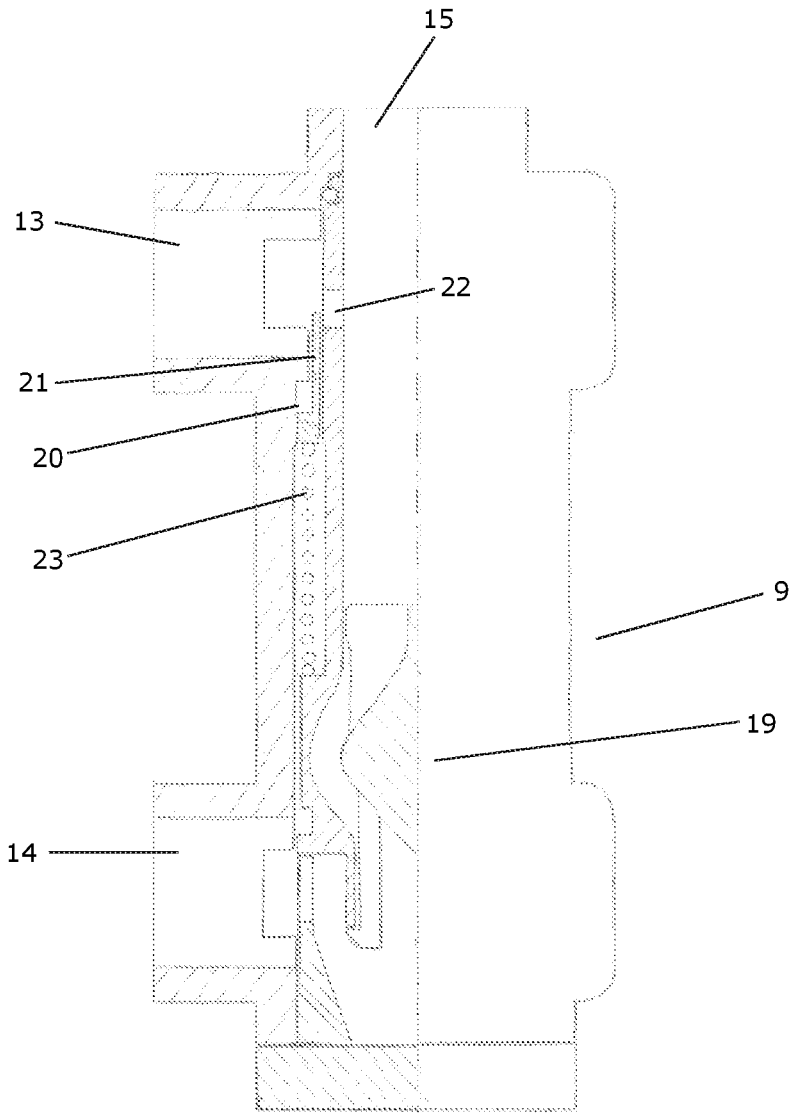
Figure 10:
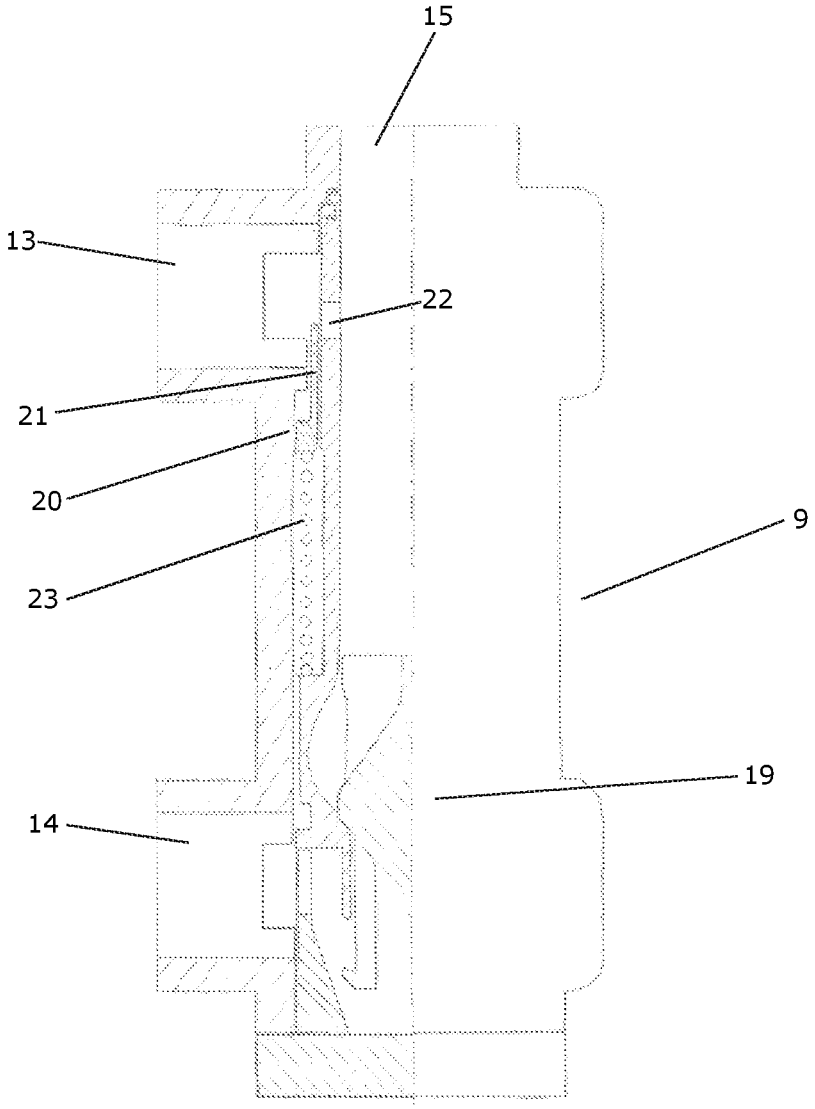
Figure 11:
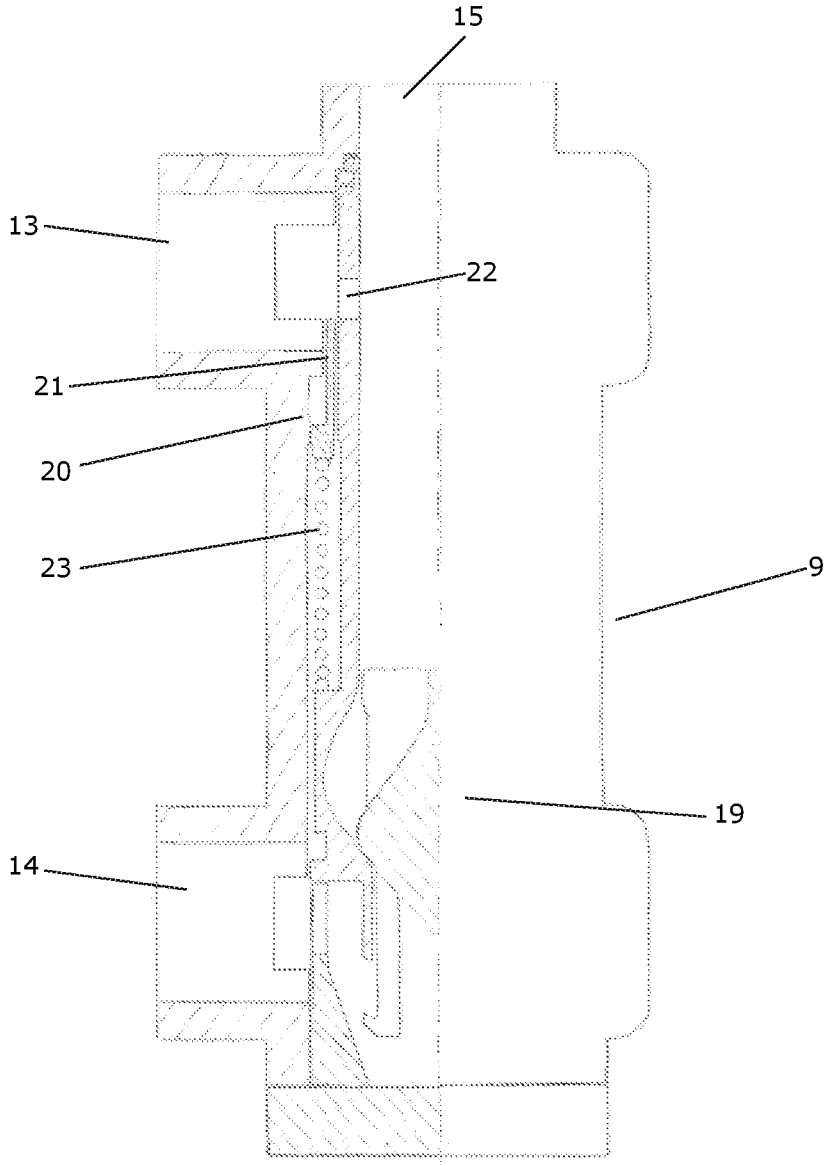

The positions of the control valve mechanism 20 and the non-return valve arrangement 19 of FIG. 7 correspond to the positions of the control valve mechanism 20 and the non-return valve arrangement 19 of FIG. 2. The positions of the control valve mechanism 20 and the non-return valve arrangement 19 of FIG. 8 correspond to the positions of the control valve mechanism 20 and the non-return valve arrangement 19 of FIG. 3. The positions of the control valve mechanism 20 and the non-return valve arrangement 19 of FIG. 9 correspond to the positions of the control valve mechanism 20 and the non-return valve arrangement 19 of FIG. 4. The positions of the control valve mechanism 20 and the non-return valve arrangement 19 of FIG. 10 correspond to the positions of the control valve mechanism 20 and the non-return valve arrangement 19 of FIG. 5. The positions of the control valve mechanism 20 and the non-return valve arrangement 19 of FIG. 11 correspond to the positions of the control valve mechanism 20 and the non-return valve arrangement 19 of FIG. 6.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A valve for use in a vapour compression system, the valve comprising:

a first inlet arranged to be connected to a gaseous outlet of a receiver, a second inlet arranged to be connected to an outlet of an evaporator, a first outlet arranged to be connected to an inlet of a compressor unit, a non-return valve arranged to allow a fluid flow from the second inlet towards the first outlet, but to prevent a fluid flow from the first outlet towards the second inlet, and a control valve arranged to control a fluid flow from the first inlet towards the first outlet, wherein the control valve is automatically operated in response to a pressure difference between a pressure prevailing at the first inlet and a pressure prevailing at the second inlet, wherein the pressure difference acts on a movable element of the control valve to automatically operate the control valve.

2. The valve according to claim 1, wherein the control valve comprises a movable valve element of the control valve being arranged movably with respect to an opening interconnecting the first inlet and the first outlet, the position of the movable valve element relative to the opening determining an opening degree of the opening, and thereby a fluid flow from the first inlet towards the first outlet.

3. The valve according to claim 2, wherein the movable valve element is biased towards a position which defines a zero opening degree of the opening.

4. The valve according to claim 3, wherein the movable valve element is arranged to perform sliding movements relative to the opening.

5. The valve according to claim 3, wherein the non-return valve is arranged to close, thereby preventing a fluid flow from the first outlet towards the second inlet, in the case that a pressure prevailing at the first outlet exceeds a pressure prevailing at the second inlet.

6. The valve according to claim 3, wherein the non-return valve is further arranged to prevent a fluid flow from the second inlet towards the first outlet, in the case that a pressure prevailing at the first outlet exceeds a pressure prevailing at the second inlet.

7. The valve according to claim 2, wherein the movable valve element is arranged to perform sliding movements relative to the opening.

8. The valve according to claim 7, wherein the non-return valve is arranged to close, thereby preventing a fluid flow from the first outlet towards the second inlet, in the case that a pressure prevailing at the first outlet exceeds a pressure prevailing at the second inlet.

9. The valve according to claim 2, wherein the non-return valve is arranged to close, thereby preventing a fluid flow from the first outlet towards the second inlet, in the case that a pressure prevailing at the first outlet exceeds a pressure prevailing at the second inlet.

10. The valve according to claim 2, wherein the non-return valve is further arranged to prevent a fluid flow from the second inlet towards the first outlet, in the case that a pressure prevailing at the first outlet exceeds a pressure prevailing at the second inlet.

11. The valve according to claim 1, wherein the non-return valve is arranged to close, thereby preventing a fluid flow from the first outlet towards the second inlet, in the case that a pressure prevailing at the first outlet exceeds a pressure prevailing at the second inlet.

12. The valve according to claim 1, wherein the non-return valve is further arranged to prevent a fluid flow from the second inlet towards the first outlet, in the case that a pressure prevailing at the first outlet exceeds a pressure prevailing at the second inlet.

13. The valve according to claim 1, further comprising a second outlet arranged to be connected to a secondary inlet of an ejector.

14. The valve according to claim 13, further comprising a separator arranged to separate refrigerant entering the valve via the second inlet into a liquid part and a gaseous part, said separator being arranged between the second inlet, the non-return valve and the second outlet.

15. A vapour compression system comprising a compressor unit comprising one or more compressors, a heat rejecting heat exchanger, an ejector, a receiver an expansion device and an evaporator arranged in a refrigerant path, an outlet of the heat rejecting heat exchanger being connected to a primary inlet of the ejector and an outlet of the ejector being connected to the receiver, wherein the vapour compression system further comprises a valve comprising:

a first inlet arranged to be connected to a gaseous outlet of the receiver, a second inlet arranged to be connected to an outlet of the evaporator, a first outlet arranged to be connected to an inlet of the compressor unit, a non-return valve arranged to allow a fluid flow from the second inlet towards the first outlet, but to prevent a fluid flow from the first outlet towards the second inlet, and a control valve arranged to control a fluid flow from the first inlet towards the first outlet, wherein the first inlet of the valve being connected to the gaseous outlet of the receiver, the second inlet of the valve being connected to the outlet of the evaporator and the first outlet of the valve being connected to the inlet of the compressor unit.

16. The vapour compression system according to claim 15, wherein the valve further comprises a second outlet, and wherein the second outlet of the valve is connected to a secondary inlet of the ejector.

17. The vapour compression system according to claim 15, wherein the control valve is automatically operated in response to a pressure difference between a pressure prevailing at the first inlet and a pressure prevailing at the second inlet.

* * * * *